United States Patent [19]

Okazaki

[11] Patent Number: 4,937,922

[45] Date of Patent: Jul. 3, 1990

[54] COUPLING ELEMENT FOR A SLIDE FASTENER

[75] Inventor: Fumio Okazaki, Tottori, Japan

[73] Assignee: Yoshida Kogyo K. K., Tokyo, Japan

[21] Appl. No.: 280,439

[22] Filed: Dec. 6, 1988

[30] Foreign Application Priority Data

Dec. 18, 1987 [JP] Japan ..... 62-320603

[51] Int. Cl.[5] ..... A44B 19/00; B05D 3/06

[52] U.S. Cl. ..... 24/403; 24/419; 427/38

[58] Field of Search ..... 24/403, 419, 423, 90 A; 427/38, 406

[56] References Cited

U.S. PATENT DOCUMENTS

| | | | |
|---|---|---|---|
| 1,969,672 | 8/1934 | Poux | 24/419 |
| 1,999,034 | 4/1935 | Clark | 24/90 A |
| 4,427,458 | 1/1984 | Hasegawa et al. | 148/6.15 R |
| 4,455,181 | 6/1984 | Lifshin et al. | 427/406 |
| 4,456,663 | 6/1984 | Leonard | 427/406 |
| 4,609,565 | 9/1986 | Yates | 427/38 |
| 4,673,586 | 6/1987 | White | 427/38 |
| 4,707,238 | 11/1987 | Okubo | 427/38 |
| 4,746,408 | 5/1988 | Hyner et al. | 427/406 |

FOREIGN PATENT DOCUMENTS 58-25760 5/1983 Japan .

*Primary Examiner*—Victor N. Sakran

*Attorney, Agent, or Firm*—Hill, Van Santen, Steadman & Simpson

[57] ABSTRACT

A coupling element for a slide fastener is disclosed which is formed of metallic alloys into a desired element shape in a discrete formation. The metallic coupling element is provided on its exposed surfaces with a protective film by ionization plating, and alternatively initially with an intermediate nickel plated layer in advance of the formation of the protective film.

3 Claims, 2 Drawing Sheets

COUPLING ELEMENT FOR A SLIDE FASTENER

BACKGROUND OF THE INVENTION

1. Field of the Invention

This invention relates generally to slide fasteners and particularly to coupling elements mounted thereon which are taken into and out of engagement with each other to close and open the slide fastener. More particularly, the invention is concerned with such coupling elements made of a metallic material and arranged in an individual discrete formation.

2. Prior Art

Individual coupling elements for slide fasteners are usually press-formed from a metal blank into the desired shape and planted in a row on and along a beaded longitudinal edge of a support fabric tape. Among conventional metallic materials for slide fastener coupling elements are known aluminum alloys, copper alloys such as nickel silver, red brass, brass and the like. The coupling elements are surface-treated by various known processes to provide thereon a protective layer of film for purposes of resistance to abrasion and corrosion, or a colored film layer for purposes of ornamental or aesthetic appeal.

There have been proposed various processes and techniques for providing such protective or ornamental films on metal surfaces which include coating, anodic oxidation such as disclosed in Japanese Patent Publication 58-25760 and chemical film formation such as disclosed in Japanese Laid-Open Patent Publication 57-93003.

The above known processes however have their inherent problems. The resulting coated films were susceptible to wear and separation from the surfaces of the fastener elements during repeated manipulation of the slider or laundering of the fastener articles. Anodic oxidation processes, being electro-chemical, involved highly costly equipment and facilities leading to increased cost of the product fastener elements. Chemical film forming processes were also objectionable in that waste fluids produced from this process would pose environmental pollution problems and the resulting film per se is weak and fragile.

SUMMARY OF THE INVENTION

With the foregoing drawbacks of the prior art in view, it is the primary objective of the present invention to provide metallic coupling elements for slide fasteners which are highly resistant to wear and to corrosion, mechanically strong and ornamentally attractive.

According to the invention, there is provided a coupling element for a slide fastener which is made of a metallic material, said element having a protective film formed on its surface by ionization plating.

Alternatively, the coupling element may be initially treated as by nickel plating in advance of ionization plating.

The above and other objects and features of the invention will be better understood from the following detailed description of the invention taken in conjunction with the accompanying drawings which illustrate by way of example a preferred embodiment of the invention.

DETAILED DESCRIPTION OF THE INVENTION

Figure 1:
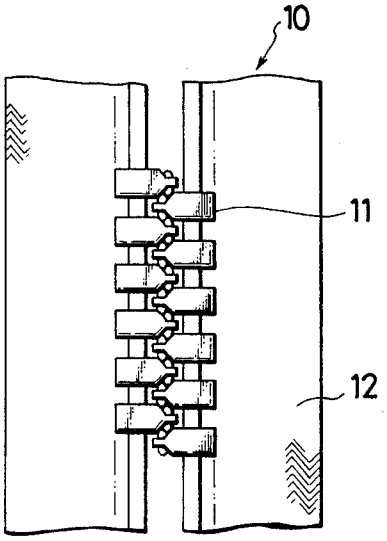
FIG. 1 is a fragmentary plan view of a slide fastener chain having mounted thereon opposed rows of metallic coupling elements embodying the invention.

Referring now to the drawings and FIG. 1 in particular, there is shown a portion of a slide fastener chain 10 carrying thereon a discrete formation of coupling elements 11 in a row attached to an inner longitudinal edge of each of a pair of support tapes 12. The coupling elements 11 on the respective tape 12 are coupled together to close the side fastener and separated from each other to open the fastener by a slider (not shown) in a manner well known in the art.

Figure 2:
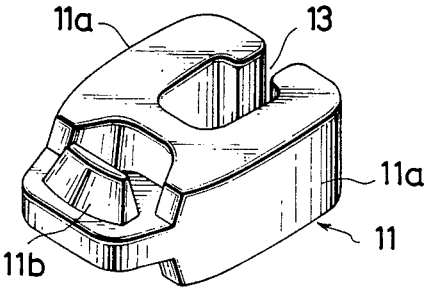
FIG. 2 is a perspective view on enlarged scale of one of the individual coupling elements provided in accordance with the invention.

Each individual coupling element 11 is made of a metallic material such as for example an aluminum alloy, a copper alloy and the like and formed as by press into a desired element shape such as one shown in FIG. 2. The formed element 11 has a pair of leg portions **11*a* spaced at one of their ends to provide a gap 13 which is closed upon clamping the two legs 11*a* onto the tape edge in a conventional manner. The element 11 has a coupling head portion 11*b* at an opposite end to the gap 13 which is releasably engageable with a counterpart of an adjacent element 11. The configuration and design of the coupling element 11** may be other than those presently shown in FIG. 2 to suit any particular application.

Now, the coupling element 11 according to the invention is provided at its outer exposed surface with a film layer about 0.3–0.5 micron thick of titanium metal 14 by means of an ionization plating process hereafter to be described. To provide a smooth and homogeneous film 14, the bare surface of the starting alloy metal 15 is preferably initially treated to form thereon a suitable intermediate layer of film 16 such as of nickel plating to a thickness of about 0.1–2.0 microns. This undercoat plating may be omitted if the starting metal surface is flat and smooth enough.

Figure 4:
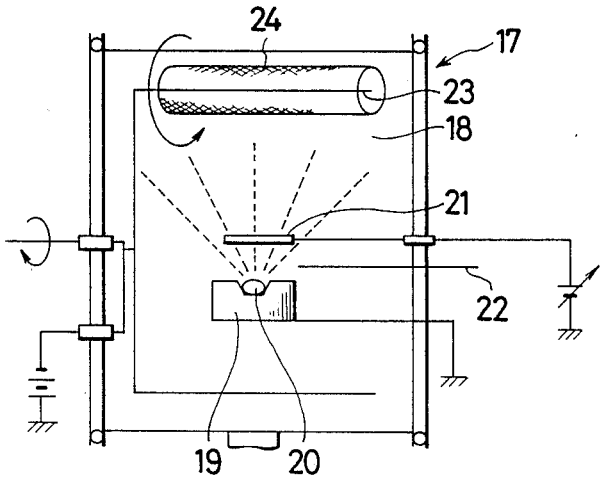
FIG. 4 is a diagrammatic view of an ionization plating equipment layout employed in accordance with the invention.

Reference to FIG. 4 diagrammatically illustrates a preferred form of ionization plating apparatus generally designated at 17 which is used to provide an ion plated coupling element in accordance with the invention. The apparatus 17 comprises a treatment chamber 18 which is maintained in vacuum condition and provided with a plasma region by glow discharge, an electron gun 19 disposed in the plasma region for irradiating an electron beam to evaporate a titanium metal 20, and an ionization electrode 21 for effecting positive ionization of evaporated titanium particles or atoms. The apparatus 17 further includes a gas feed tube 22 which supplies a reactive gas such as oxygen and nitrogen to the ionization system, the reactive gas being also ionized to some extent, a support 23 having a negative potential and a rotative barrel 24 surrounding the support 23 and containing metallic elements 11 onto which the positively ionized metal vapor is directed and deposited uniformly while the barrel 24 is in rotation.

Figure 3:
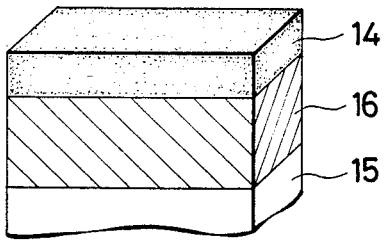
FIG. 3 is a diagrammatic perspective view of the coated layer structure of the coupling element.

Further details of the apparatus 17 will not require explanation as they are known to one skilled in the art. The titanium vapor is allowed to react with the reactive gas on the surfaces of the elements 11, which have been heated upon impinging contact with the metal vapor, thereby forming thereon a thin high-density film 14 (FIG. 3). This film may be differently colored depending upon the type of the reactive gas used, for instance, if the reactive gas is oxygen applied to previously nickel-plated element surfaces 16 (FIG. 3), the resulting film 14 will be of titanium oxide ($TiO_2$), which is a film of high refractory index and transparency, the film being therefore capable of exhibiting a substantially rainbow of spectrum color upon interference by light.

A mixture of acetylene and nitrogen gases may be used as the reactive gas to react with the titanium metal vapor under controlled conditions of evaporation velocity, ionization electrode potential and gas pressure thereby forming a titanium cyanamide (TiCN) film 14 which is black in color. With nitrogen used alone as the reactive gas, there may be provided a titanium nitride (TiN) film 14 on the coupling element 11 which presents a gold surface color.

There may be obtained different shades of colors by varying the feed rate of the reactive gas.

It will be thus understood that the coupling elements 11 for slide fasteners processed by ionization plating under the invention are provided with a protective film 14 firmly bonded to their surfaces which is highly resistant to wear in repeated sliding contact with the slider, to separation or corrosion during laundering or dyeing and free from scratches when mounting the elements 11 on the tapes 12. In addition, it is possible to provide the elements 11 with a variety of colors by adjusting the ionization plating conditions as appear apparent to those skilled in the art.

While it is not always necessary to provide a nickel-plated intermediate layer 16 on the coupling element 11, the advantage of using this intermediate layer is that the protective film 25 overlying the same is capable of, in addition to other advantageous characteristics, presenting aesthetically attractive rainbow hues by photo interference.

Obviously, various modifications and variations of the present invention are possible in the light of the above teaching. It is therefore to be understood that within the scope of the appended claims the invention may be practiced otherwise than as specifically described.

What is claimed is:

1. A coupling element for a slide fastener which is made of a metallic material, said element having an intermediate nickel plated layer on its surface and a protective film formed thereover by ionization plating, said protective film comprising at least one of titanium oxide and titanium nitride to enhance the appearance of the slide fastener by providing a multi hued rainbow effect.

2. A coupling element as claimed in claim 1 wherein said protective film is formed by titanium oxide.

3. A coupling element as claimed in claim 1 wherein said protective film is formed by titanium nitride.

* * * * *